US008057512B1

(12) United States Patent
Gibson

(10) Patent No.: US 8,057,512 B1
(45) Date of Patent: Nov. 15, 2011

(54) COMBINED TEETHING RING AND PACIFIER AND ASSOCIATED METHOD

(76) Inventor: Rhonda Gibson, Hanover, MD (US)

( * ) Notice: Subject to any disclaimer, the term of this patent is extended or adjusted under 35 U.S.C. 154(b) by 634 days.

(21) Appl. No.: 12/284,697

(22) Filed: Sep. 24, 2008

Related U.S. Application Data

(60) Provisional application No. 60/994,918, filed on Sep. 24, 2007.

(51) Int. Cl.
*A61J 17/00* (2006.01)

(52) U.S. Cl. ..... 606/235

(58) Field of Classification Search ..... 606/234–236; D24/194–197
See application file for complete search history.

(56) References Cited

U.S. PATENT DOCUMENTS 3,669,117 A 6/1972 Herbst
5,606,871 A 3/1997 Hansen
6,905,507 B2 6/2005 Hinshaw

*Primary Examiner* — Gary Jackson
*Assistant Examiner* — Eric Blatt

(57) ABSTRACT

A combined teething ring and pacifier may include a support member with a pacifier section and a teething ring section extending from the posterior and anterior sides thereof respectively. The teething ring may be removably coupled to the support member such that it may be removed therefrom while the pacifier remains situated inside the infant oral cavity. Multiple teething rings may be available to interchange with a single support member and pacifier. Further, the support member may include an automatic reciprocating mechanism for reciprocating the teething ring along an arcuate direction as the infant inhales air into the pacifier. The mechanism preferably includes an actuator that rotates inside an ambient-air diverting chamber as the infant breaths. With each rotation, the actuator contacts a trigger attached to the teething ring. The trigger may reciprocate along a linear path, thus urging the teething ring along the arcuate direction.

19 Claims, 5 Drawing Sheets

COMBINED TEETHING RING AND PACIFIER AND ASSOCIATED METHOD

CROSS REFERENCE TO RELATED APPLICATIONS

This application claims the benefit of U.S. Provisional Application No. 60/994,918, filed Sep. 24, 2007, the entire disclosures of which are incorporated herein by reference.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to pacifiers and, more particularly, to a combined teething ring and pacifier for providing user enjoyment during extended periods of time.

2. Prior Art

Baby soothers, and particularly pacifiers, have been in common use for many years. It is well known that pacifiers provide the most comfort to accommodate irritable infants. As a result, pacifiers are typically made of both soft and hard rubber and any other material which combines elasticity and resiliency to provide a surface best suited to relieve the discomfort of teething and to satisfy the infant's desire to suckle. Sometimes, however, infants prefer chewing or teething a much harder surface than that of a pacifier, which typically requires the use of an additional apparatus. With multiple objects, there is a tendency for parents, and infants, to become frustrated when one or the other becomes misplaced or completely lost.

U.S. Pat. No. 3,669,117 to Herbst discloses a combination teether and pacifier in the form of a thin walled, flexible body having nipple, guard, and teething portions which are hollow and in communicating relation to each other. Unfortunately, this prior art reference fails to disclose a movable exterior portion that the child may play with for personal amusement.

U.S. Pat. No. 5,606,871 to Hansen discloses a pacifier shaped teether with an internal bladder filled with food grade propylene glycol which can be brought to freezing temperatures while maintaining its liquid nature. There is a hollow portion in the mouth guard of the pacifier which is connected to a hemispherical chamber allowing room for expansion of the bladder into the chamber as the nipple is being sucked. One or more pacifier shaped teethers may be stored in a portable, insulated, gel ice filled storage container thereby keeping the pacifiers cold for several hours. Unfortunately, this prior art reference does not provide a teething unit in a variety of unique shapes, not only allow a baby to ease the pain from cutting teeth, but also to provide the baby with amusement.

U.S. Pat. No. 6,905,507 to Hinshaw discloses a teething pacifier comprising a pacifier guard having two opposing sides, a nipple extending outwardly from one side of the pacifier guard and a handle associated with the opposite side of the pacifier guard. The handle includes a first teething material and a second teething material having a substantially similar hardness as that of the first teething material. The second teething material is molded over the first teething material to create a varied teething surface on the handle for infant teething thereon. The first teething material may further include an over mold enhancing surface such as a keyway extending around the handle, at least one flat face extending around the handle and/or at least one recess extending around the circumference of the handle at select points on the handle. Unfortunately, this prior art reference also does not provide interchangeable parts, and a baby is likely to lose interest after a short period of time, resulting in the parent having to buy multiple units.

Accordingly, a need remains for a combined teething ring and pacifier in order to overcome the above-noted shortcomings. The present invention satisfies such a need by providing an apparatus that is convenient and easy to use, is durable yet lightweight in design, is versatile in its applications, and provides user enjoyment during extended periods of time.

BRIEF SUMMARY OF THE INVENTION

In view of the foregoing background, it is therefore an object of the present invention to provide an apparatus and associated method for providing user enjoyment during extended periods of time. These and other objects, features, and advantages of the invention are provided by a combined teething ring and pacifier.

A combined teething ring and pacifier for providing user enjoyment during extended periods of time preferably includes a pacifier section with a support member and a bulbous protrusion extending away from the support member. The bulbous protrusion preferably is extended in such a manner that it remains disposed at a posterior side of the support member when the pacifier section is situated inside an oral cavity of the infant. At the same time, the support member may also remain exterior of the infant's oral cavity. In this manner, an infant gently sucks on the bulbous protrusion of the pacifier for relief in times of distress.

Additionally, a teething ring section may be removably coupled to the support member and configured in such a manner that the teething ring remains disposed at an anterior side of the support member when the pacifier section is situated inside the infant's oral cavity. The teething ring section may be detached from the support member and placed in a freezer and cooled to provide further comfort to the infant. One skilled in the art recognizes cold therapy to be an effective method for soothing a teething infant. This feature offers an added benefit in that the infant may handle the reattached teething ring without the inconvenience and discomfort of handling a frozen pacifier.

Advantageously, the removable teething rings section may be produced in different shapes and sizes so that the user may interchange the teething rings with the support member to accommodate the teething needs of an infant. The different shapes and colors can be used as an early teaching tool and also to help differentiate one pacifier from another in daycare settings to prevent the sharing of germs. One configuration of the teething ring may include a static protrusion extending out from the support member. This teething ring may be filled with water or a non-toxic gel-like substance and used for cold therapy. Another configuration may include a pivotal teething ring, downwardly suspended from the anterior side of the support member.

The apparatus may also include a mechanism for automatically reciprocating the teething ring section along a first arcuate direction as the infant inhales air along a second arcuate direction. This operates so that the teething ring section repeatedly pivots along a bi-directional curvilinear travel path defined along the first arcuate direction while the teething ring section remains situated at the anterior side of the support member. Further, the first arcuate direction may be defined anterior of the support member.

The automatic teething ring section reciprocating mechanism may further include an ambient-air diverting chamber seated within the support member and a deformable bladder adjustably seated within the ambient-air diverting chamber. The deformable bladder preferably includes a flexible lining contiguously oriented along an inner wall of the ambient-air diverting chamber.

Additionally, the mechanism may include an actuator rotatably seated within the bladder and maintaining continuous contact with the flexible liner. The actuator may be selectively rotated along clockwise and counter clockwise travel paths situated adjacent to a second arcuate direction and thereby periodically may engage the teething ring section during each revolution inside the bladder.

The infant may suck or blow air into the bulbous protrusion and against the bladder, causing the bladder to push against the actuator. In turn, this causes the actuator to operate the mechanism.

Further, the teething ring section may be articulated along the bi-directional curvilinear travel path defined along the first arcuate direction when the actuator rotates along counter clockwise and clockwise directions respectively. This action may provide the infant with an entertaining activity, as it may observe the teething ring moving outside of their mouth.

The automatic teething ring section reciprocating mechanism further may include an inlet orifice and an outlet orifice respectively situated at diametrically opposed regions of the ambient-air diverting chamber. The inlet orifice may be in fluid communication with ambient air while the outlet orifice is in fluid communication with the infant's oral cavity. This feature assists the infant in breathing with the pacifier situated in the oral cavity. Of course, the thickness of the bladder can be calibrated to accommodate the air pressure associated with the child's inhalation and exhalation for providing the necessary force to operate the teething ring section reciprocating mechanism.

In addition, an anchor shaft may be centrally registered within the bladder and equidistantly offset from the inlet and outlet orifices respectively. Also, a plurality of blades may be journaled about the anchor shaft and radially extending away therefrom. Further, a plurality of circular cams may be statically coupled directly to distal ends of the blades respectively so that a cam is coupled to the distal end of each blade. This operates such that each cam may maintain a continuous frictional engagement against the flexible liner during inhaling and exhaling procedures.

Ambient air may be urged along a first passageway defined between the inner surface of the chamber and an outer surface of the flexible liner when the ambient air ingresses through the inlet orifice and egresses from the outlet orifice respectively as the infant inhales. Also, the ambient air may be urged along a second passageway defined between the inner surface of the chamber and the outer surface of the flexible liner when ambient air ingresses into the outlet orifice and egresses from the inlet orifice respectively as the infant exhales.

The ambient air, traveling alternately along the first and second passageways, may push the flexible lining against the cams and thereby cause the blades to articulate along the second arcuate direction such that the cams may frictionally glide along the flexible lining. One of the pivotal teething ring sections may be rotatably mounted to the anterior side of the support member. The teething ring section may include a trigger with a first end directly connected to the teething ring section and a second end penetrating into the ambient-air diverting chamber. The trigger and actuating lever preferably traverse the bi-direction curvilinear travel path such that the trigger resiliently reciprocates along an arcuate path as the flexible liner is urged against the inner surface of the chamber during each revolution of the cams respectively.

In particular, when the cams rolls over the inner surface, the actuating pin is urged outwardly along a reciprocating linear path and thereby causes the trigger to pivot and bias the teething ring section along an arcuate path. Thus, the linear reciprocating movement of the actuating pin automatically causes a portion of the teething ring section to resiliently articulate along the first arcuate direction by way of biasing the trigger.

A method for utilizing the combined teething ring and pacifier may include the first step of providing a pacifier section with a support member and a bulbous protrusion extending away from the support member in such a manner that the bulbous protrusion remains disposed at a posterior side of the support member when the pacifier section is situated inside an oral cavity of an infant.

The method may also include the second step of positioning the protrusion inside the infant's oral cavity. Next, the method may include the step maintaining the support member exterior of the infant oral cavity. Fourth, the method may include the step of providing and removably coupling a teething ring section to the support member. Fifth, the method may entail maintaining the teething ring section at an anterior side of the support member after the pacifier section is situated inside the infant oral cavity.

Finally, the method may include the step of automatically reciprocating the teething ring section along a first arcuate direction as the infant inhales air along a second arcuate direction so that the teething ring section repeatedly pivots along a bi-directional curvilinear travel path defined along the first arcuate direction while the teething ring section remains situated at the anterior side of the support member.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

It is noted the purpose of the foregoing abstract is to enable the U.S. Patent and Trademark Office and the public generally, especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 1:
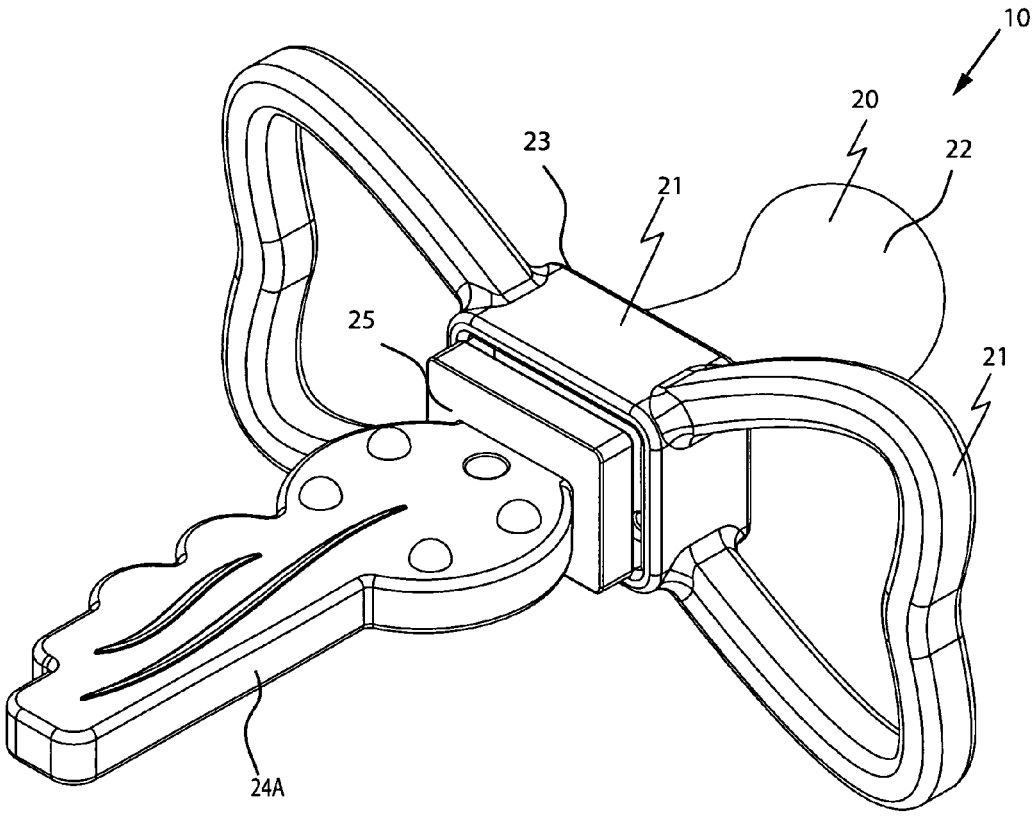
FIG. 1 is a perspective view showing a combined teething ring and pacifier with a static teething ring section removably attached to the pacifier, in accordance with the present invention.
Figure 2:
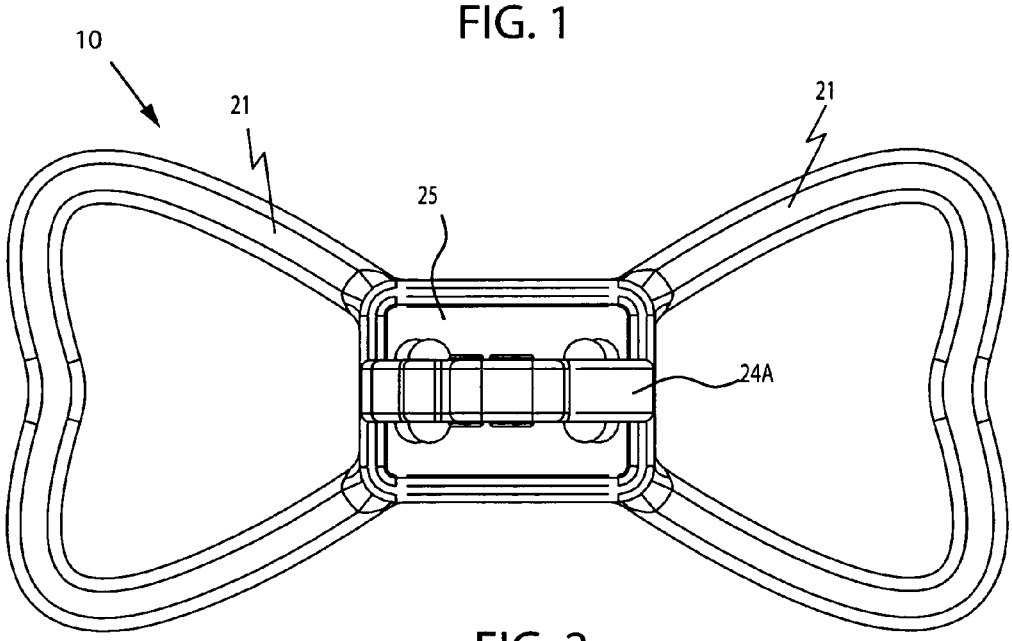
FIG. 2 is a front elevational view of FIG. 1.
Figure 3:
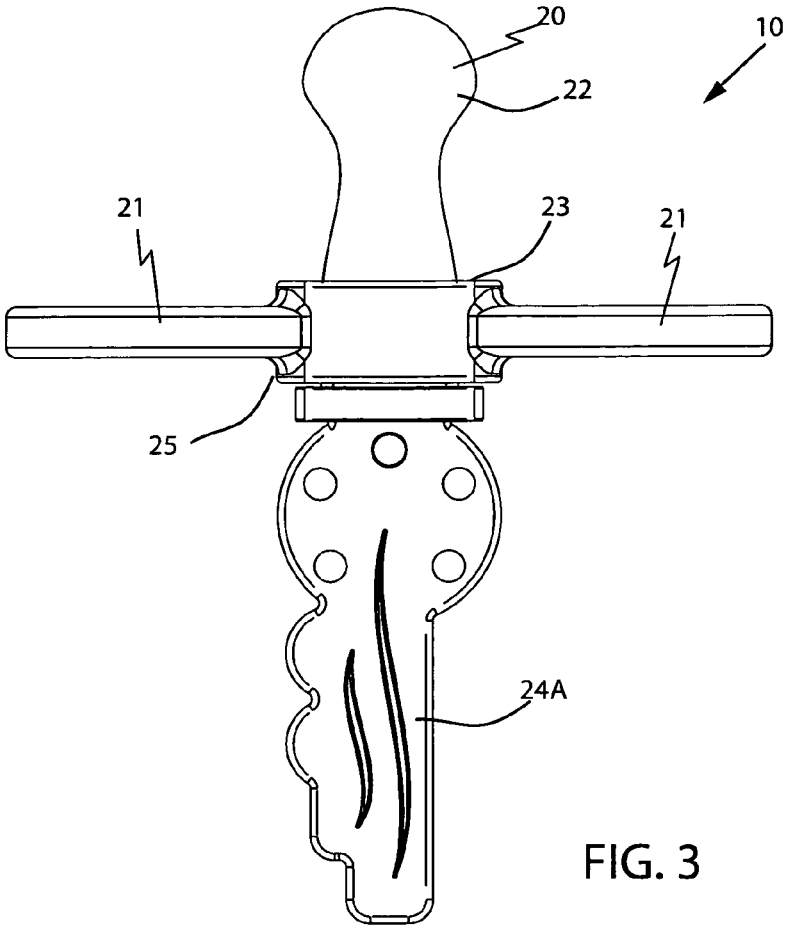
FIG. 3 is a top plan view of FIG. 1.
Figure 4:
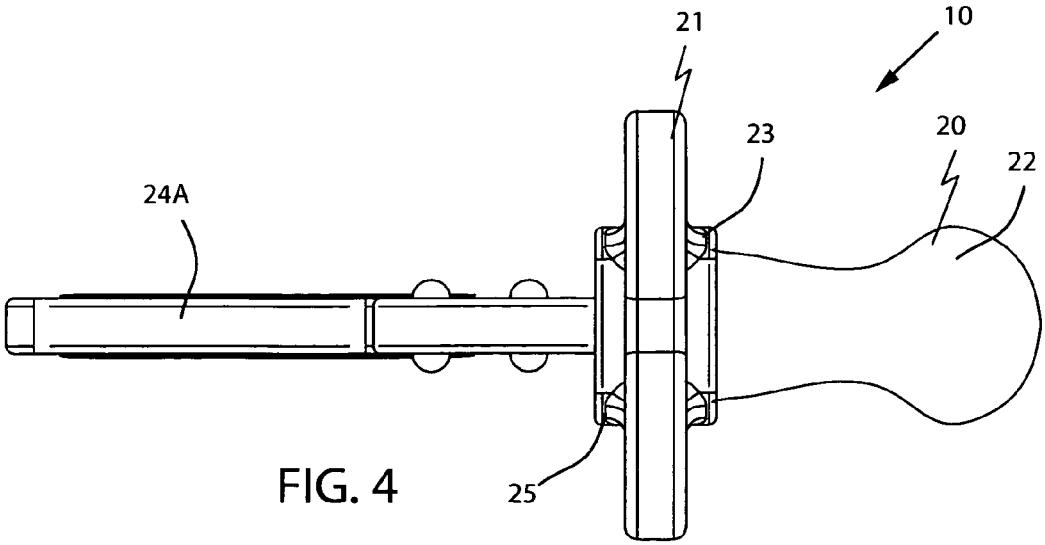
FIG. 4 is a side elevational view of FIG. 1.
Figure 5:
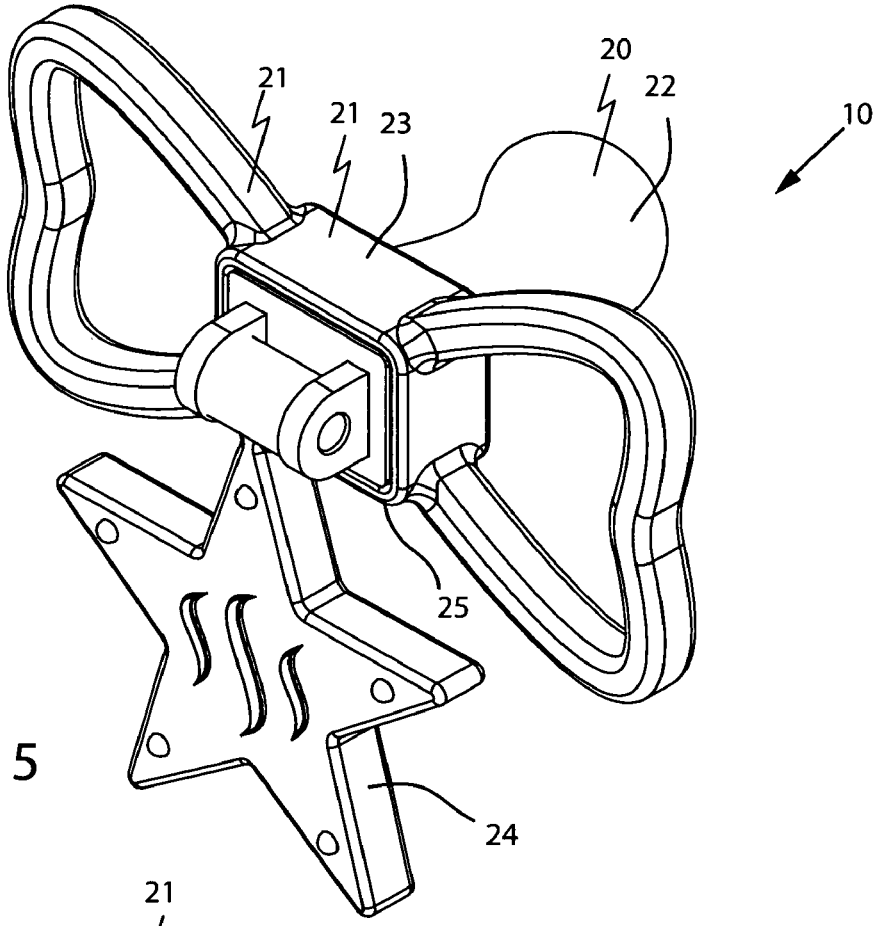
FIG. 5 is a perspective view showing an alternate embodiment of the combined teething ring and pacifier with a pivotal teething ring section removably attached to the pacifier.
Figure 6:
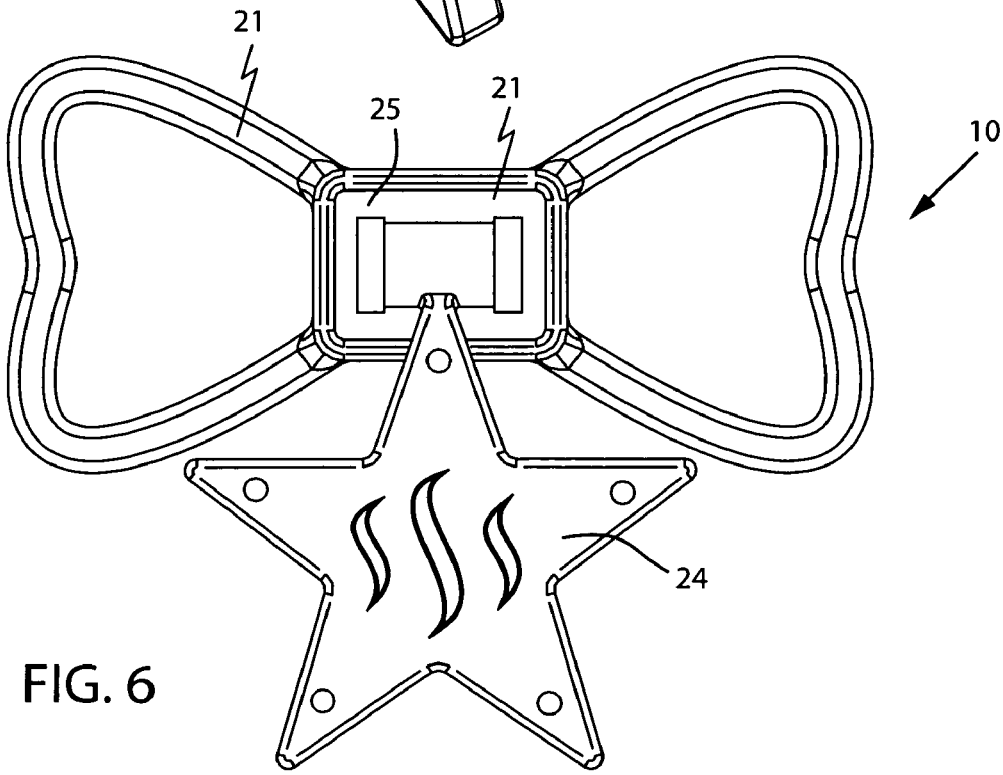
FIG. 6 is a front elevational view of FIG. 5.

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art. Like numbers refer to like elements throughout the figures.

The apparatus of this invention is referred to generally in FIGS. 1-9 by the reference numeral 10 and is intended to provide a combined teething ring and pacifier. It should be understood that the apparatus 10 may be used to provide, user enjoyment many different types of infant and child needs and should not be limited in use to the applications mentioned herein.

Referring to FIGS. 1-9, a combined teething ring and pacifier 10 preferably includes a pacifier section 20 with a support member 21 and a bulbous protrusion 22 extending away from the support member 21. Such a bulbous protrusion 22 preferably extends in such a manner that it remains disposed at a posterior side 23 of the support member 21 when the pacifier section 20 is situated inside an oral cavity of the infant. At the same time, the support member 21 may also remain exterior of the infant's oral cavity. The pacifier section 20 provides relief to child or infant. In this manner, an infant gently sucks on the bulbous protrusion 22 of the pacifier for relief in times of distress.

Additionally, a teething ring section 24 may be removably coupled to the support member 21 and configured in such a manner that the teething ring 24 remains disposed at an anterior side 25 of the support member 21 when the pacifier section 20 is situated inside the infant's oral cavity. Because the teething ring section 24A may be removably coupled to the support member 21, it may be detached and placed in a freezer and cooled to provide further comfort to the infant. One skilled in the art recognizes the beneficial effect that cold therapy has on a teething infant. These combined features provide a valuable benefit wherein the infant may continue to suckle the pacifier section 20 while the teething ring section 24A is detached and placed in a freezer to cool. Further, after the cooled teething ring section 24A is reattached to the support member 21, the infant may handle the apparatus 10 without the discomfort of handling an undesirably cooled pacifier 20 by holding onto the support member 21.

The removable teething ring sections 24 may be produced in different shapes and sizes to accommodate individual infant teething needs. One configuration may include a static protrusion 24A extending out from the anterior side 25 of the support member, as seen in FIGS. 1-4. Another configuration may include a pivotal teething ring 24, downwardly suspended from the anterior side 25 of the support member 21, as seen in FIGS. 5-9.

Figure 7:
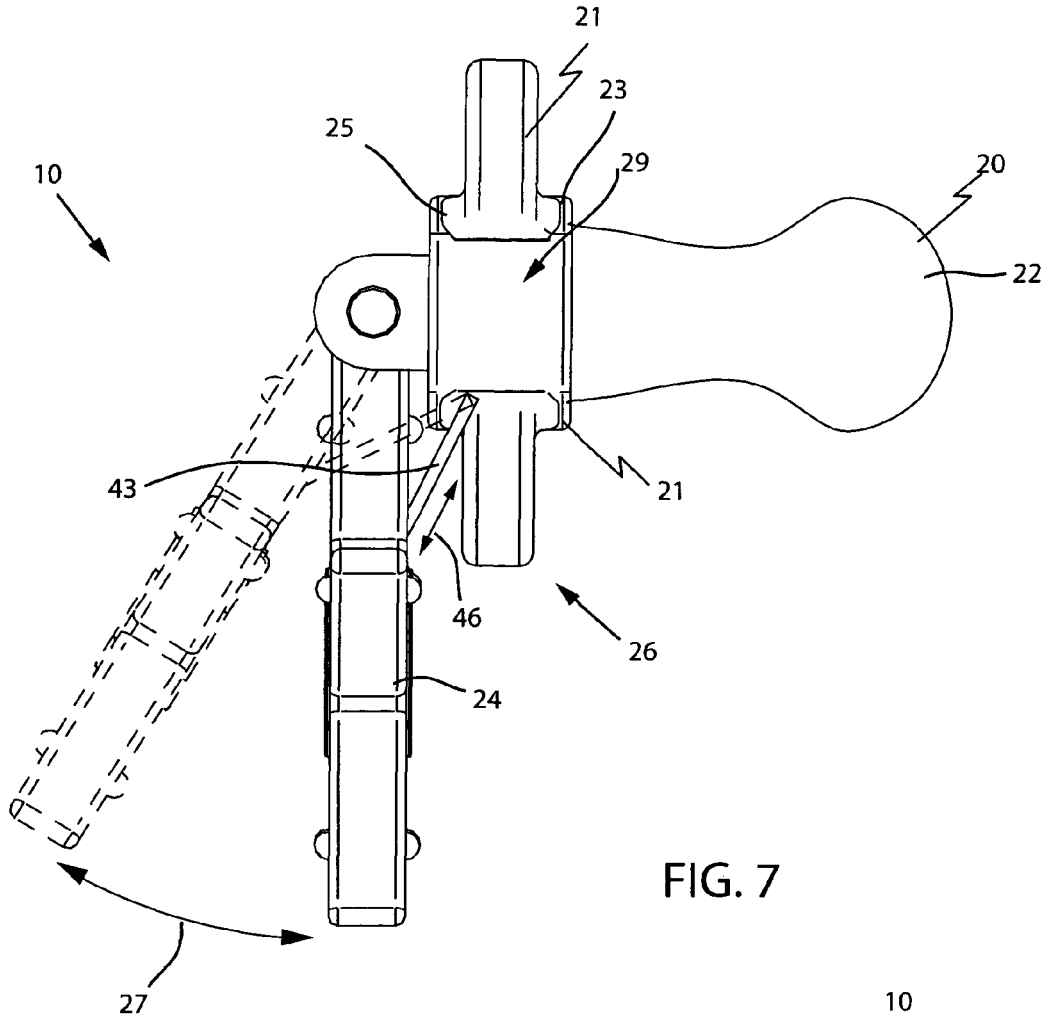
FIG. 7 is a side elevational view of showing a break away of the automatic teething ring section reciprocating mechanism including the ambient-air diverting chamber as well as showing teething ring section traveling along the bi-directional curvilinear travel path, which is defined by the first arcuate direction.
Figure 8:
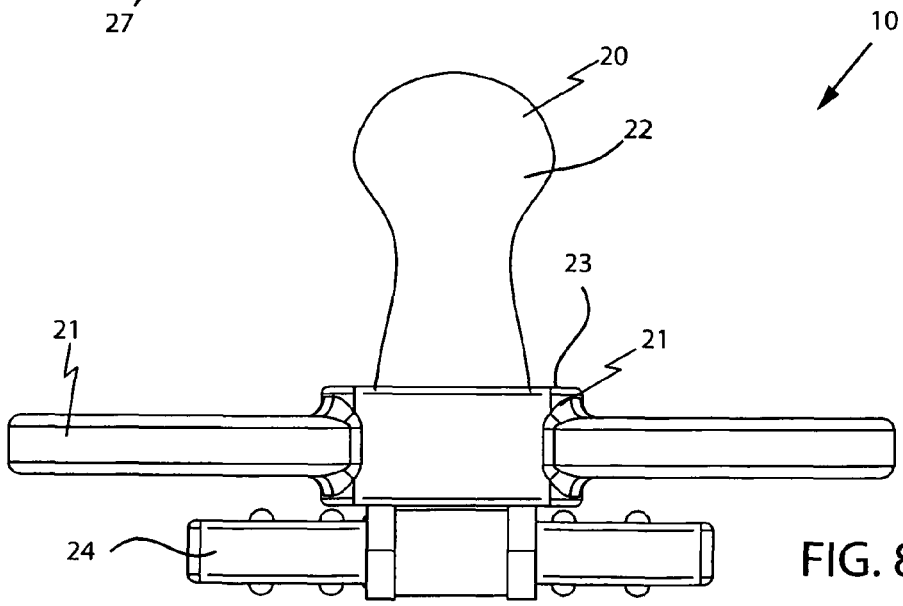
FIG. 8 is a top plan view of FIG. 5.
Figure 9:
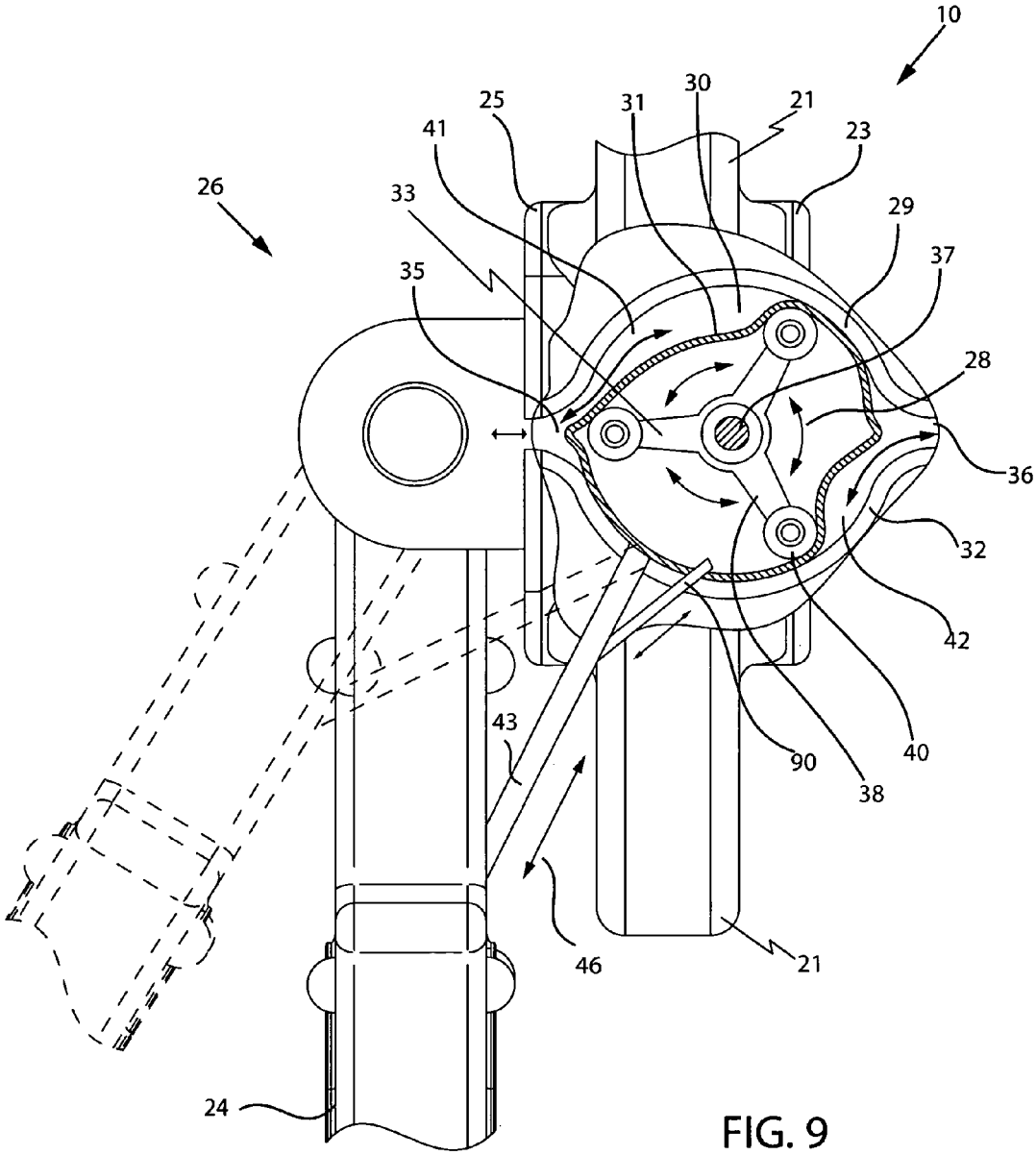
FIG. 9 is an enlarged break away view, showing actuation of the automatic teething ring section reciprocating mechanism.

Referring to FIGS. 7 and 9, the apparatus 10 may further include is a mechanism 26 for automatically reciprocating the teething ring section 24 along a first arcuate direction 27 as the infant inhales air along a second arcuate direction 28. This operates so that the teething ring section 24 repeatedly pivots along a bi-directional curvilinear travel path defined along the first arcuate direction 27 while the teething ring section 24 remains situated at the anterior side 25 of the support member 21. Further, the first arcuate direction 27 may be defined anterior of the support member 21 and the second arcuate direction 28 may be defined within the pacifier section 20.

Referring again to FIGS. 7 and 9, the automatic teething ring section reciprocating mechanism 26 may further include an ambient-air diverting chamber 29 seated within the support member 21 and a deformable bladder 30 adjustably seated within the ambient-air diverting chamber 29. The deformable bladder 30 may have a flexible lining 31 contiguously oriented along an inner wall 32 of the ambient-air diverting chamber 29. Additionally, the mechanism 26 may include an actuator 33 rotatably seated within the bladder 30 and maintaining continuous contact with the flexible liner 31. The actuator 33 may be selectively rotated along clockwise and counter clockwise travel paths situated adjacent to the second arcuate direction 28 and thereby periodically may engage the teething ring section 24 during each revolution inside the bladder 30. The infant may inhale or exhale air against the bladder 30 to push against the actuator 33. In turn, this causes the actuator 33 to operate the mechanism 26, as explained further hereinbelow.

Further, the teething ring section 24 may be articulated along the bi-directional curvilinear travel path defined along the first arcuate direction 27 when the actuator 33 rotates along counter clockwise and clockwise directions respectively. This action may provide the infant with an entertaining activity, as they may observe the teething ring 24 moving outside their mouth. Also, the valuable feature aides in comforting the infant by diverting its attention away from pain and discomfort associated with teething.

Referring, in particular, to FIG. 9, the automatic teething ring section reciprocating mechanism 26 further may include an inlet orifice 35 and an outlet orifice 36 respectively situated at diametrically opposed regions of the ambient-air diverting chamber 29. The inlet orifice 35 may be in fluid communication with ambient air while the outlet orifice 36 may be in fluid communication with the infant's oral cavity. This feature assists the infant in breathing while the pacifier section 20 is situated in the oral cavity. Of course, the bladder thickness may be calibrated to accommodate various inhalation and exhalation flow rates so that air pressure associated with the infant's inhalation and exhalation provides the necessary force to operate the teething ring section reciprocating mechanism 26. The combination of such elements provide an additional benefit wherein the caretaker may readily determine whether or not the infant is breathing by observing the reciprocating motions of the teething ring section 24.

In addition, an anchor shaft 37 may be centrally registered within the bladder 30 and equidistantly offset from the inlet 35 and outlet 36 orifices respectively. Also, a plurality of blades 38 may be journaled about the anchor shaft 37 and radially extending away therefrom. Further, a plurality of circular cams 40 may be statically coupled directly and without the use of intervening elements to distal ends of the blades 38 respectively. This operates which is important that each of the cams 40 may maintain a continuous frictional engagement against the flexible liner 31 during inhaling and exhaling procedures. Ambient air from the infant's inhalations and exhalations pushes the bladder 30 against the cams 40, which, in turn, cause the blades 38 to turn and rotate the actuator 33.

Ambient air may be urged along a first passageway 41 defined between the inner surface 32 of the chamber 29 and an outer surface of the flexible liner 31 when the ambient air ingresses through the inlet orifice 35 and egresses from the outlet orifice 36 respectively as the infant inhales. Additionally, the ambient air may be urged along a second passageway 42 defined between the inner surface 32 of the chamber 29 and the outer surface of the flexible liner 31 when ambient air ingresses into the outlet orifice 36 and egresses from the inlet orifice 35 respectively as the infant exhales. In this fashion, air travels along the first passageway 41 during inhalation and along the second passageway 42 during exhalation.

Referring again to FIGS. 7 and 9, the ambient air, traveling alternately along the first 41 and second 42 passageways, may push the flexible lining 31 against the cams 40 and thereby cause the blades 38 to articulate along the second arcuate direction 28 such that the cams 40 may frictionally glide along the flexible lining 31. The combined elements of the flexible lining 31 pushing against the cams 40 provide an unexpected benefit of prohibiting the infant's air from directly contacting the cams 40, the blades 38, or the actuator 33. Such an advantageous benefit overcomes prior art shortcomings wherein human breath moisture causes mechanical parts to malfunction over time. Thus, the flexible lining 31 ensures that the present invention will be durable and will provide an extended period of use and enjoyment.

Referring to FIGS. 7 and 9, one of the pivotal teething ring sections 24 may be rotatably mounted to the anterior side 25 of the support member 21. The teething ring section 24 may include a trigger 43 with a first end 44 directly connected to the teething ring section 24 and a second end 45 penetrating into the ambient-air diverting chamber 29. A lever 90 intersects the travel path of the cams 40 and is statically coupled directly to the trigger 43. The lever 90 preferably traverses the bi-direction curvilinear travel path such that the lever 90 resiliently reciprocates along a linear path and thereby biases the trigger 43 along an arcuate path 46 as the flexible liner 31 is urged against the inner surface of the chamber 29 during each revolution of the cams 40. In particular, when the cams 40 roll over the inner surface of the flexible lining 31, the lever 90 is urged outwardly along a reciprocating linear path and thereby causes the trigger 43 to pivot the teething ring section 24 along an arcuate path (as shown in FIGS. 7 and 9). Accordingly, the arcuate reciprocating movement of the trigger 43 automatically causes a portion of the teething ring section 24 to resiliently articulate along the first arcuate direction 27.

As the actuator 33 rotates due to ambient air traveling along the first 41 and second 42 passageways, each cam 40 periodically pushes against the flexible lining 31 which pushes against the lever 90 against the trigger 43, which is connected to the teething ring section 24. Thus, with each breath, the infant causes the teething ring section 24 to pivot back and forth along the bi-directional curvilinear travel path defined along the first arcuate direction 27. By employing the infant's breathing to power the automatic teething ring reciprocating mechanism 26, the present invention provides the infant with entertainment without the need for batteries or other external energy sources.

In use, a method for utilizing the combined teething ring and pacifier 10 to provide user enjoyment during extended periods of time may include the first step of providing a pacifier section 20 with a support member 21 and a bulbous protrusion 22 extending away from the support member 21 in such a manner that the bulbous protrusion 22 remains disposed at a posterior side of the support member 21 when the pacifier section 20 is situated inside an oral cavity of an infant. The method may include the second step of positioning the bulbous protrusion 22 inside the infant's oral cavity.

The method may further include the third step of maintaining the support member 21 exterior of the infant oral cavity. Fourthly, the method may include the step of providing and removably coupling a teething ring section 24 to the support member 21. Fifth, the method may entail the step of maintaining the teething ring section 24 disposed at an anterior side of the support member 21 after the pacifier section 20 is situated inside the infant oral cavity.

Finally, the method may include a sixth step of automatically reciprocating the teething ring section 24 along a first arcuate direction 27 as the infant inhales air along a second arcuate direction 28 so that the teething ring section repeatedly pivots along a bi-directional curvilinear travel path defined along the first arcuate direction 27 while the teething ring section 24 remains situated at the anterior side of the support member 21.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed as new and what is desired to secure by Letters Patent of the United States is:

1. A combined teething ring and pacifier for providing user enjoyment during extended periods of time, said teething ring and pacifier comprising:

a pacifier section including a support member and a protrusion extending away from said support member in such a manner that said protrusion remains disposed at a posterior side of said support member when said pacifier section is situated inside an oral cavity of the infant;

a teething ring section removably coupled to said support member and configured in such a manner that said teething ring remains disposed at an anterior side of the said support member when said pacifier section is situated inside the infant oral cavity; and means for automatically reciprocating said teething ring section along a first arcuate direction as the infant inhales air along a second arcuate direction so that said teething ring section repeatedly pivots along a bi-directional curvilinear travel path defined along said first arcuate direction while said teething ring section remains situated at said anterior side of said support member;

wherein said first arcuate direction is defined anterior of said support member and said second arcuate direction is defined within said pacifier section.

2. The combined teething ring and pacifier of claim 1, wherein said automatic teething ring section reciprocating means comprises:

an ambient-air diverting chamber seated within said support member;

a deformable bladder adjustably seated within said ambient-air diverting chamber, said deformable bladder having a flexible lining contiguously oriented along an inner wall of said ambient-air diverting chamber; and an actuator rotatably seated within said bladder and maintaining continuous contact with said flexible liner;

wherein said actuator is selectively rotated along clockwise and counter clockwise travel paths situated adjacent to said second arcuate direction and thereby periodically engages said teething ring section during each revolution inside said bladder.

3. The combined teething ring and pacifier of claim 2, wherein said teething ring section is articulated along said bi-directional curvilinear travel path defined along said first arcuate direction when said actuator rotates along counter clockwise and clockwise directions respectively.

4. The combined teething ring and pacifier of claim 3, wherein said automatic teething ring section reciprocating means further comprises:

an inlet orifice and an outlet orifice respectively situated at diametrically opposed regions of said ambient-air diverting chamber, said inlet orifice being in fluid communication with ambient air, said outlet orifice being in fluid communication with the infant oral cavity;

an anchor shaft centrally registered within said bladder and equidistantly offset from said inlet and outlet orifices respectively;

a plurality of blades journaled about said anchor shaft and radially extending away therefrom; and a plurality of circular cams statically coupled directly to distal ends of said blades respectively wherein each of said cams maintains a continuous frictional engagement against said flexible liner during inhaling and exhaling procedures.

5. The combined teething ring and pacifier of claim 4, wherein the ambient air is urged along a first passage way defined between said inner surface of said chamber and an outer surface of said flexible liner when the ambient air ingresses through said inlet orifice and egresses from said outlet orifice respectively.

6. The combined teething ring and pacifier of claim 5, wherein the ambient air is urged along a second passage way defined between said inner surface of said chamber and said outer surface of said flexible liner when ambient air ingresses into said outlet orifice and egresses from said inlet orifice respectively.

7. The combined teething ring and pacifier of claim 6, wherein the ambient air pushes said flexible lining against said cams and thereby causes said blades to articulate along said second arcuate direction such that said cams frictionally glide along said flexible lining.

8. The combined teething ring and pacifier of claim 7, wherein said teething ring section is rotatably mounted to said anterior side of said support member and comprises: a trigger having a first end directly connected to said teething ring section and further having a second end penetrating into said ambient-air diverting chamber, said trigger traversing said bi-direction curvilinear travel path such that trigger is resiliently reciprocated a linear path as said flexible liner is urged against said inner surface of said chamber during each revolution of said cams respectively.

9. The teething ring and pacifier of claim 8, wherein said linear reciprocating movement of said trigger automatically causes a portion of said teething ring section to resiliently articulate along said first arcuate direction.

10. A combined teething ring and pacifier for providing user enjoyment during extended periods of time, said teething ring and pacifier comprising:

a pacifier section including a support member and a bulbous protrusion extending away from said support member in such a manner that said bulbous protrusion remains disposed at a posterior side of said support member when said pacifier section is situated inside an oral cavity of the infant, said support member remaining exterior of the infant oral cavity;

a teething ring section removably coupled to said support member and configured in such a manner that said teething ring remains disposed at an anterior side of the said support member when said pacifier section is situated inside the infant oral cavity; and means for automatically reciprocating said teething ring section along a first arcuate direction as the infant inhales air along a second arcuate direction so that said teething ring section repeatedly pivots along a bi-directional curvilinear travel path defined along said first arcuate direction while said teething ring section remains situated at said anterior side of said support member;

wherein said first arcuate direction is defined anterior of said support member and said second arcuate direction is defined within said pacifier section.

11. The combined teething ring and pacifier of claim 10, wherein said automatic teething ring section reciprocating means comprises:

an ambient-air diverting chamber seated within said support member;

a deformable bladder adjustably seated within said ambient-air diverting chamber, said deformable bladder having a flexible lining contiguously oriented along an inner wall of said ambient-air diverting chamber; and an actuator rotatably seated within said bladder and maintaining continuous contact with said flexible liner;

wherein said actuator is selectively rotated along clockwise and counter clockwise travel paths situated adjacent to said second arcuate direction and thereby periodically engages said teething ring section during each revolution inside said bladder.

12. The combined teething ring and pacifier of claim 11, wherein said teething ring section is articulated along said bi-directional curvilinear travel path defined along said first arcuate direction when said actuator rotates along counter clockwise and clockwise directions respectively.

13. The combined teething ring and pacifier of claim 12, wherein said automatic teething ring section reciprocating means further comprises:

an inlet orifice and an outlet orifice respectively situated at diametrically opposed regions of said ambient-air diverting chamber, said inlet orifice being in fluid communication with ambient air, said outlet orifice being in fluid communication with the infant oral cavity;

an anchor shaft centrally registered within said bladder and equidistantly offset from said inlet and outlet orifices respectively;

a plurality of blades journaled about said anchor shaft and radially extending away therefrom; and a plurality of circular cams statically coupled directly to distal ends of said blades respectively wherein each of said cams maintains a continuous frictional engagement against said flexible liner during inhaling and exhaling procedures.

14. The combined teething ring and pacifier of claim 13, wherein the ambient air is urged along a first passage way defined between said inner surface of said chamber and an outer surface of said flexible liner when the ambient air ingresses through said inlet orifice and egresses from said outlet orifice respectively.

15. The combined teething ring and pacifier of claim 14, wherein the ambient air is urged along a second passage way defined between said inner surface of said chamber and said outer surface of said flexible liner when ambient air ingresses into said outlet orifice and egresses from said inlet orifice respectively.

16. The combined teething ring and pacifier of claim 15, wherein the ambient air pushes said flexible lining against said cams and thereby causes said blades to articulate along said second arcuate direction such that said cams frictionally glide along said flexible lining.

17. The combined teething ring and pacifier of claim 16, wherein said teething ring section is rotatably mounted to said anterior side of said support member and comprises: a trigger having a first end directly connected to said teething ring section and further having a second end penetrating into said ambient-air diverting chamber, said trigger traversing said bi-direction curvilinear travel path such that trigger is resiliently reciprocated a linear path as said flexible liner is urged against said inner surface of said chamber during each revolution of said cams respectively.

18. The teething ring and pacifier of claim 17, wherein said linear reciprocating movement of said trigger automatically causes a portion of said teething ring section to resiliently articulate along said first arcuate direction.

19. A method for utilizing a combined teething ring and pacifier to provide user enjoyment during extended periods of time, said method comprising the chronological steps of:

a. providing a pacifier section including a support member and a bulbous protrusion extending away from said support member in such a manner that said bulbous protrusion remains disposed at a posterior side of said support member when said pacifier section is situated inside an oral cavity of the infant;

b. positioning said protrusion inside the infant oral cavity;

c. maintaining said support member exterior of the infant oral cavity;

d. providing and removably coupling a teething ring section to said support member;

e. maintaining said teething ring section disposed at an anterior side of the said support member after said pacifier section is situated inside the infant oral cavity; and f. automatically reciprocating said teething ring section along a first arcuate direction as the infant inhales air along a second arcuate direction so that said teething ring section repeatedly pivots along a bi-directional curvilinear travel path defined along said first arcuate direction while said teething ring section remains situated at said anterior side of said support member;

wherein said first arcuate direction is defined anterior of said support member and said second arcuate direction is defined within said pacifier section.

* * * * *